United States Patent [19]

Kawasaki

[11] 4,327,903

[45] May 4, 1982

[54] WORK CLAMPING VISE

[76] Inventor: Shosuke Kawasaki, 2400-15, Ohaza Kita Toyama, Komaki City, Aichi Prefecture, Japan

[21] Appl. No.: 152,792

[22] Filed: May 23, 1980

[30] Foreign Application Priority Data

May 25, 1979 [JP] Japan ..... 54/071010[U]

[51] Int. Cl.[3] ..... B25B 1/02

[52] U.S. Cl. ..... 269/194; 269/212

[58] Field of Search ..... 269/134, 137, 171, 194, 269/195, 165, 207, 211-215, 252

[56] References Cited

U.S. PATENT DOCUMENTS

| | | | |
|---|---|---|---|
| 408,473 | 8/1889 | Focken | 269/171 X |
| 540,413 | 6/1895 | Vanderbeek | 269/194 X |
| 2,511,843 | 6/1950 | Graether | 269/212 X |

FOREIGN PATENT DOCUMENTS 50-45753 12/1975 Japan .

*Primary Examiner*—Robert C. Watson
*Attorney, Agent, or Firm*—Anthony J. Casella

[57] ABSTRACT

Herein provided is a vise of the type, in which a movable clamping jaw is made slidable on a base having a stationary clamping jaw at its one end toward and away from the stationary jaw and is connected to the base by means of a connecting member. The base is formed at its widthwise center with a longitudinal groove, which extends in the longitudinal direction through the upper and lower sides thereof, and in its lower side with a number of transverse grooves which extend at the both sides of the longitudinal groove. The movable clamping jaw is formed with a recess which is wider than the longitudinal groove of the base and which has its bottom extending in parallel with the upper side of the base and formed with a through hole. The connecting member is received in the recess such that it can move in the longitudinal direction of the longitudinal groove. There is formed a leg which extends from the bottom center of the connecting member through the through hole into the longitudinal groove and which is bent to extend within the longitudinal groove toward the stationary clamping jaw. A pin is fixed to the free end of the leg and is made to engage with one of the afore-mentioned transverse grooves. On the other hand, the connecting member is formed with a threaded hole which extends in the moving direction of the movable jaw so that it may receive a bolt. There may preferably be attached to the vise a spring for biasing the connecting member to the stationary clamping jaw and/or a spring for biasing the rear end of the bolt in the downward direction.

8 Claims, 9 Drawing Figures

WORK CLAMPING VISE

BACKGROUND OF THE INVENTION

1. Field of the Invention

The present invention relates to a vise which is mounted on the bed of a grinding machine thereby to fix a work in position or which is used to fix a work for a cutting operation.

2. Description of the Prior Art

A usual vise is made to have its one clamping jaw fixed to the base thereof and its other movable clamping jaw made movable toward and away from the stationary clamping jaw by means of a threaded rod. This threaded rod is made operative to move the movable clamping jaw over the movable range thereof, i.e., over the maximum stroke (within which the clamping operations can be effected by the stationary and movable clamping jaws).

In case the spacing between the stationary and movable clamping jaws is enlarged to clamp a larger work after a smaller work has once been clamped, or in case the opposite operations to the above are to be accomplished, it is desired that the movable jaw can be abruptly moved. For this purpose, it is also desired that the screw pitch of the threaded rod for effecting the clamping operation and the movement of the movable jaw be made to have a considerable value. With the pitch reduced, the movement of the movable jaw becomes reluctant. With the pitch excessively increased, the fastening force is weakened, while a high turning force being required, and the work once clamped is liable to become loose.

One of the vises for promptly changing the position of the movable clamping jaw while being free from the looseness after the clamping operation has been proposed and found in Japanese Utility Model Publication No. 50-45753 which was published for public inspection on Dec. 24, 1975.

In the vise disclosed in the above-specified publication, the leg is made to extend at an angle of 45 degrees from the bottom of the connecting member, which is held in the movable clamping jaw, through the through hole, which is formed in the bottom of the movable jaw, to a position below the base so that the pin carried on its leading end is brought into engagement with one of the transverse grooves which are formed in the bottom of the base. As a result, that portion of the movable jaw at the side of the stationary jaw, through which the through hole extends, has its thickness so reduced as to establish such a problem when used for clamping a heavy work that a crack is formed in the inner wall of the longitudinal wall which is formed to extend longitudinally along the center line of the base. This problem can be solved if the thickness of the movable jaw from the recess accommodating the connecting member to the portion facing the stationary jaw is increased. With this increase in thickness, however, since the portion of the movable jaw to be fixed to the base by the action of the connecting member, i.e., the intersection of the action lines in the so-called "composition of forces" goes farther from the work clamping sides, there arises another problem that the movable jaw becomes so instable that it is liable to float from the base.

It has therefore been found that the vise thus disclosed can be used to clamp a small work having a weight up to several ten kilograms but is not constructionally suitable for clamping a large clamp having a weight as heavy as several tons.

SUMMARY OF THE INVENTION

It is, therefore, an object of the present invention, to provide a vise which can clamp a work without fail.

Another object of the present invention is to provide a vise which can safely clamp a large work.

Still another object of the present invention is to provide a vise which can be operated without any difficulty.

A further object of the present invention is to provide a safety mechanism for use with a vise.

According to the present invention, a vise is provided to include a base equipped with a stationary clamping portion at its one end, a movable clamping portion made slidable on the base relative to the stationary clamping portion, and a latch for connecting the movable clamping portion to the base. A longitudinal groove is formed to extend in the longitudinal direction through the upper and lower sides at the widthwise center of the base. A multiplicity of transverse grooves are formed in the lower side of the base and at the both sides of the longitudinal groove. On the other hand, the latch is constructed to include a connecting member recessed in the recess of the movable clamping portion, a generally L-shaped leg, and a pin mounted on the leading end of the leg and made engageable with one of the transverse grooves. The connecting member is formed with a threaded hole, in which is fastened a bolt for having its leading end pushing the inner side of the recess.

There is interposed between the connecting member and a cover covering the rear side of the former and the recess a spring for urging the connecting member toward the stationary clamping portion. Moreover, the connecting member has its corners rounded.

In order to arrange the bolt and the base in parallel, moreover, there is provided a pushing mechanism for ensuring the engagement between the pin of the leg and the transverse grooves.

DESCRIPTION OF THE PREFERRED EMBODIMENTS

Figure 1:
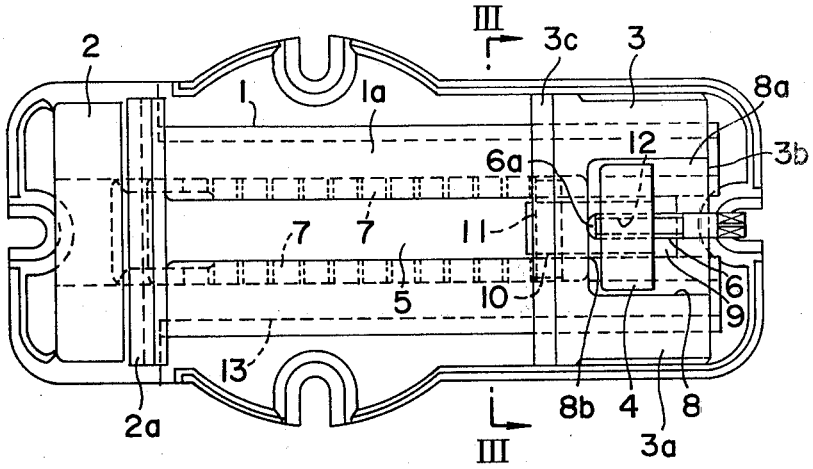
FIG. 1 is a top plan view showing a vise according to one embodiment of the present invention.

A vise according to the present invention will now be described in connection with one embodiment thereof with reference to FIGS. 1 to 3. Indicated at numeral 1 is a base, which is formed at its widthwise center with such a longitudinal groove 5 as extends in the longitudinal direction through the upper and lower sides 1*a* and 1*b* of the base 1. The lower side 1*b* is formed with a number of transverse grooves 7 which are made to extend in two rows at the both sides of the longitudinal groove 5 in such a rib shape that they face their partners at a present spacing. From the both side ends of the lower side 1*b*, there are formed a pair of legs 13 which extend in the longitudinal and downward directions so that they may be fixed to the bed of a working machine.

There is integrally formed at one end of the base 1 a stationary clamping jaw 2, to which a movable clamping jaw 3 is juxtaposed in a manner to slide on the base 1. On the other hand, the movable clamping jaw 3 has its both lower guide edges 3*d* formed to have a U-shaped section thereby to hold the upper side 1*a* of the base 1 at the both side edges. A recess 8 is formed to extend over the corner portion between the upper and rear sides 3*a* and 3*b* of the movable clamping jaw 3. The recess 8 is formed to have its center positioned just above the longitudinal groove 5 and to have a larger width than the same. Moreover, the recess 8 has its bottom 8*a* formed in parallel with the upper side 1*a* of the base 1. A through hole 9 is formed to extend downward from the bottom 8*a* such that it has the same width as that of the longitudinal groove 5 and that it is aligned with the same groove 5.

There is fitted in the recess a connecting member 4 which is sized to be snugly received therein. The connecting member 4 is made sufficiently shorter than the recess 8 in the longitudinal direction of the base 1, while having its both sides positioned in the vicinity of the facing inner sides of the recess 8, so that its bottom 4*a* is placed to ride on the bottom 8*a* of the recess 8 (as shown in FIG. 3). There is made integral with the center of the bottom 4*a* of the connecting member 4 a generally L-shaped leg 10 which is made to extend through the through hole 9 of the movable clamping jaw 3 into the longitudinal groove 5 of the base 1 and which is bent within the groove 5 toward the stationary fastening jaw 2. A pin 11 is fixed to extend from the leading end portion of the leg 10 such that it can be fitted in one of the transverse grooves 7.

The connecting member 4 is formed with a threaded screw 12, which extends in the moving direction of the movable clamping jaw 3 and into which a bolt 6 is fastened.

The length of the through hole 9 taken in the fastening direction is made at least one pitch larger than the length of the leg 10 in the same direction so that the movable clamping jaw 3 can be moved back and forth in the fastening direction at least one pitch of the transverse grooves 7 without any shift of the leg 10.

Indicated at numeral 2*a* is a clamping plate which is made of a hardened material and which is fixed to the clamping side of the stationary clamping jaw 2. Indicated at numeral 3*c* is a similar clamping plate which is fixed to the clamping side of the movable clamping jaw 3.

Figure 2:
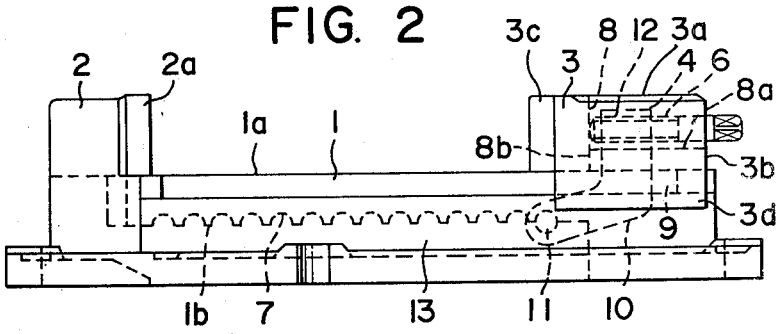
FIG. 2 is a side elevation of the vise of FIG. 1.
Figure 3:
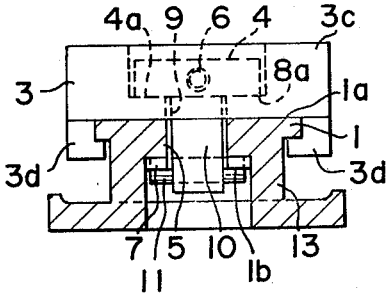
FIG. 3 is a section taken along line III—III of FIG. 1.

As shown in FIGS. 1 to 3, therefore, if the connecting member 4 is supported by the transverse groove 7, in which the pin 11 is fitted through the leg 10 (as better shown in FIG. 2), the bolt 6 has its leading end 6*a* pushing the inner side 8*b* of the recess 8, when it is screwed, so that the movable clamping jaw 3 is forced to slide on the base toward the stationary clamping jaw 2.

As is apparent from FIGS. 1 to 3, in the position where the pin 11 of the leg 10 is fitted in one of the transverse grooves 7, the movable clamping jaw 3 can be moved a distance equal to the clearance between the leg 10 and the through hole 9 in the fastening direction. This movable range is set to sufficiently overlap another movable range of the movable clamping jaw 3 in case the pin 11 is shifted in one of the adjacent transverse grooves 7.

Now, the pin 11 and the transverse groove 7 are disengaged in the following manner. The connecting member 4 cannot be moved under the condition, in which its bottom 4*a* is fitted in the bottom 8*a* of the recess 8 of the movable clamping jaw 3 and in which the bolt 6 has its leading end 6*a* forced into contact with the inner side 8*b* of the recess 8. First of all, the movable clamping jaw 3 is moved forward as much as possible toward the stationary clamping jaw 2 with respect to the connecting member 4, and the bolt 6 is then turned to extract its leading end 6*a* into the connecting member 4. In, under this particular condition, the bolt 6 is manually pinched upward, the leg 10 is turned about the contact point between the corner 15 defined by the connecting member 4, more specifically, by the front and bottom sides of the member 4 and the bottom 8*a* of the recess 8 so that the pin 11 can be disengaged from one of the transverse grooves 7. The connecting member 4 is shifted on the base together with the movable clamping jaw 3, while holding that condition, so that the pin 11 of the leg 10 can be fitted again in one of the transverse grooves 7 by reseating the bottom 4*a* of the connecting member 4 in the bottom 8*a* of the recess 8.

Incidentally, although not explicitly illustrated in the embodiment of FIGS. 1 to 3, the corner 15 of the connecting member 4 may preferably be rounded, as will be described in connection with the embodiments shown in FIG. 4 and so on.

The vise according to the present invention is so constructed that the stepwise position change of the movable clamping jaw 3 can be easily accomplished merely by consecutively fitting the latch, which is composed of the connecting member 4, the leg 10 and the pin 11, in one of the grooves 7 which are formed in a rack shape in the lower side of the base 1, and that the connecting member 4 and the movable clamping jaw 3 are made so movable relative to each other as to have their relative position adjusted within a short range by means of the bolt 6. Since, moreover, the bolt to be used may have a small screw pitch, there can be obtained an advantage that a large clamping force can be established by a relatively small fastening force while eliminating any looseness after the fastening operation.

In the embodiment thus far described according to the present invention, since the leg 10 of the connecting member 4 is bent, as viewed from the side in FIG. 2, the action portion of the holding force of the movable clamping jaw upon the base by the connecting member 4, i.e., the intersection of the action lines of the so-called "composition of forces" can be located not far from the work clamping side of the movable jaw 3. Thus, it is possible to provide a large vise which can clamp even a large and heavy work stably without fail and which can have its clamping distance promptly changed while being free from looseness.

Figure 4:
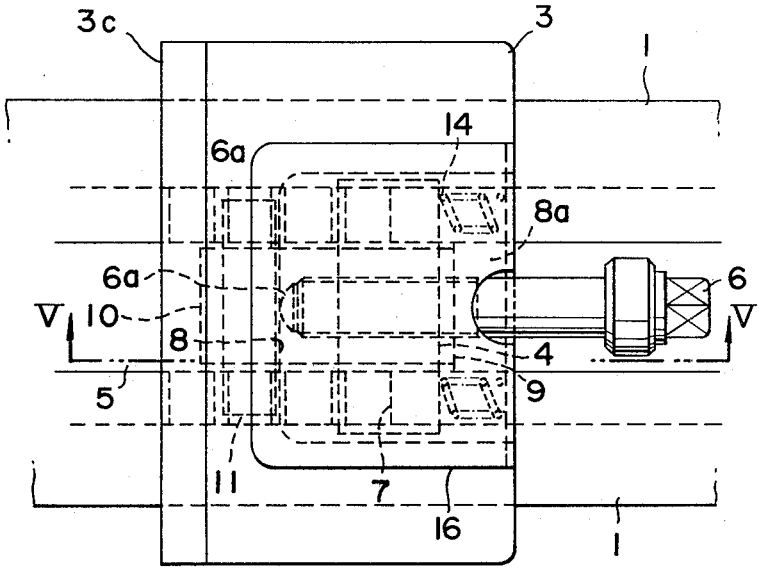
FIG. 4 is a partially enlarged top plan view showing another embodiment of the present invention.
Figure 5:
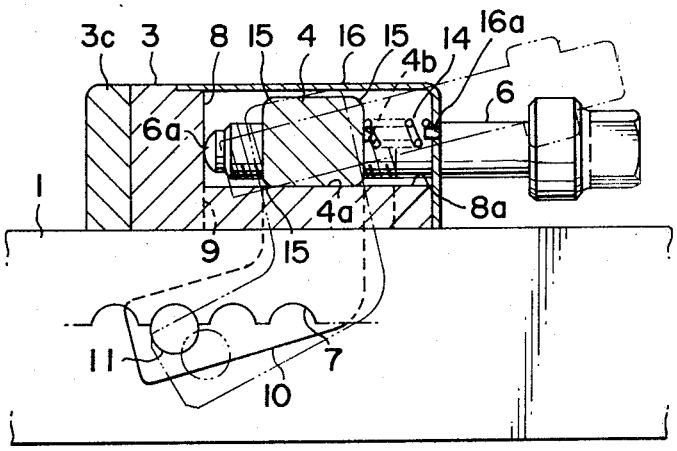
FIG. 5 is a section taken along line V—V of FIG. 4.

Reference will be turned to FIGS. 4 and 5 showing another embodiment of the present invention.

In this second embodiment, the corner 15 of the connecting member 4, which extends at a right angle with respect to the moving direction of the movable clamping jaw 3, is rounded, and a spring 14 for pushing or pulling the connecting member 4 to or from the stationary clamping jaw 2, is interposed between the connecting member 4 and the movable clamping jaw 3. According to the second embodiment, more specifically, a cover 16 covering the recess 8 to make integral with the movable clamping jaw 3, and the spring 14 is interposed between the cover 16 and the connecting member 4 in a manner to push the connecting member 4 toward the stationary clamping jaw 2. Those portions of the cover 16 and the connecting member 4, with which the spring 14 contacts, are formed with projections 16*a* and 4*b*, respectively, on which the spring 14 has its ends portions fitted to have its abutting positions immovable.

In an alternative, incidentally, the connecting member 4 may have its portion protruding to the both sides of the movable clamping jaw 3 through the apertures, which are formed in the both sides of the movable jaw 3, so that a tensile or compression spring may be interposed between that portion and the movable jaw 3.

In the vise used to clamp a heavy work, the connecting member 4 itself bocomes so large that it cannot be manually operated with ease. According to the second embodiment, however, the connecting member 4 is always pulled within the recess 8 toward the stationary jaw 2 by the action of the spring 14 as the leading end 6*a* of the bolt 6 is retracted toward the connecting member 4. More specifically, when the leading end 6*a* of the bolt 6 is retracted into the connecting member 4, this member 4 brings its leading side into abutment contact with the inner side 8*b* of the recess 8. As a result, if, in order to change the position of the movable jaw 3, the portion of the bolt 6 protruding to the clamping plate 3*c* is extracted to renew the fitted engagement between the pin 11 and one of the transverse grooves 7, the connecting member 4 is brought without any manual operation into the closest position within the recess 8 to the stationary jaw 2 so that the clamping range by the bolt 6 can be enlarged at any time. In order to remove the pin 11 from the transverse groove 7, it is necessary to incline the connecting member 4 in the manner shown in dotted lines in FIG. 5. This operation can be facilitated by rounding the corner 15 of the connecting member 4, which extends at a right angle with respect to the moving direction, as shown in FIG. 5.

According to this second embodiment, moreover, since the clamping operation is performed with the connecting member 4 being positioned as close as possible to the clamping plate 3*c* by the action of the spring 14, the more stable clamped condition can always be attained so that a work having a large size can be fixed reliably and stably without any difficulty.

Other embodiments of the present invention will now be described with reference to FIGS. 6 to 9.

In these embodiments, the corner 15 of the connecting member 4, which extends at a right angle with respect to the moving direction of the movable clamping jaw 3, is rounded, and the cover 16 covering the recess 8 is made integral with the movable jaw 3 in a similar manner to the embodiment shown in FIGS. 4 and 5.

Figure 6:
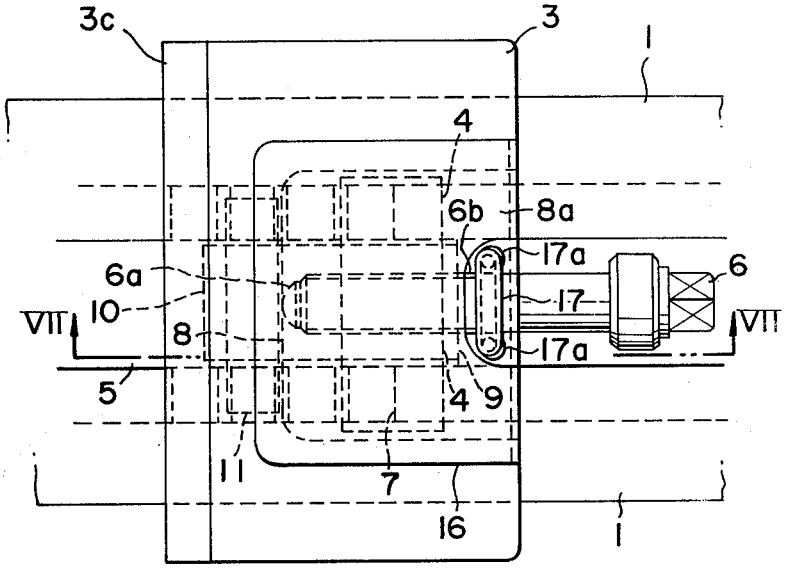
FIG. 6 is a partially enlarged view showing still another embodiment of the present invention.
Figure 7:
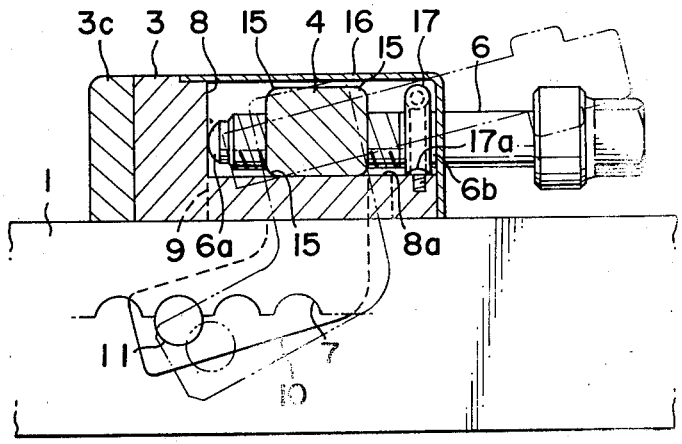
FIG. 7 is a section taken along line VII—VII of FIG. 6.

In the embodiment shown in FIGS. 6 and 7, more specifically, a helical spring 17 is wound in the form of a letter "U" upon the circumference 6*b* of the bolt 6, which is located farther, as viewed from the stationary clamping jaw 2, such that its both ends are fixed to the bottom 8*a* of the recess 8 by means of screws 17*a*.

Figure 8:
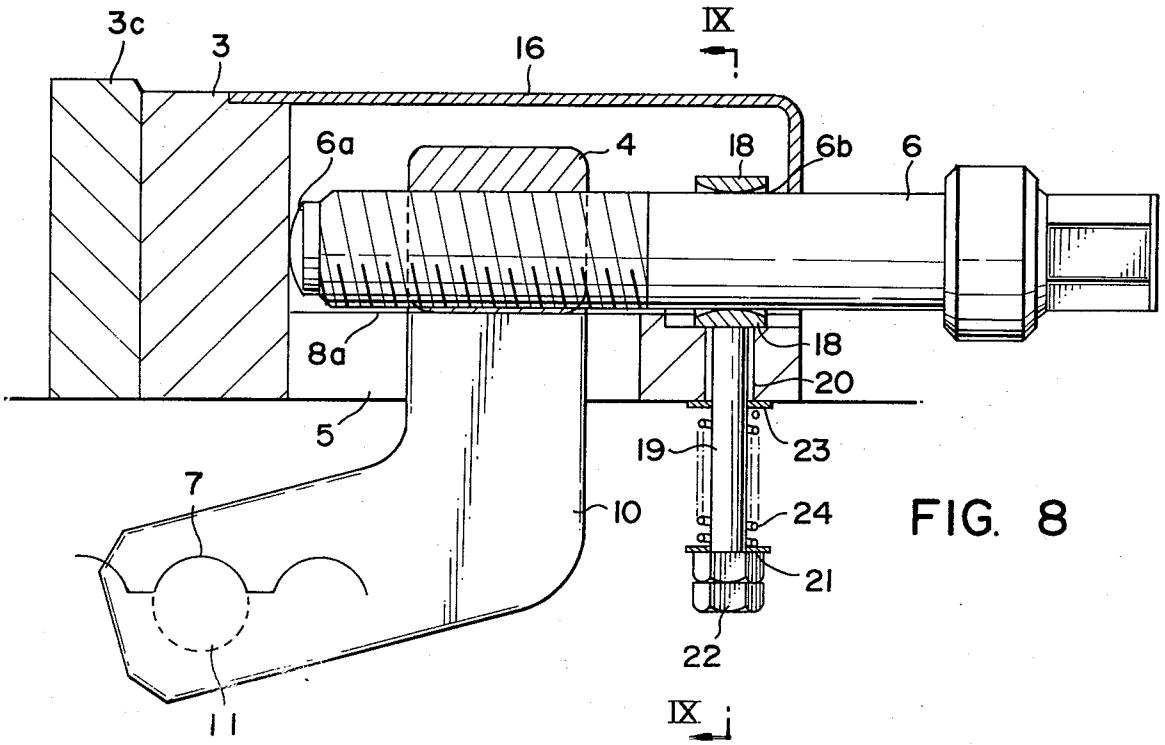
FIG. 8 is a partially sectional side elevation showing a further embodiment of the present invention.
Figure 9:
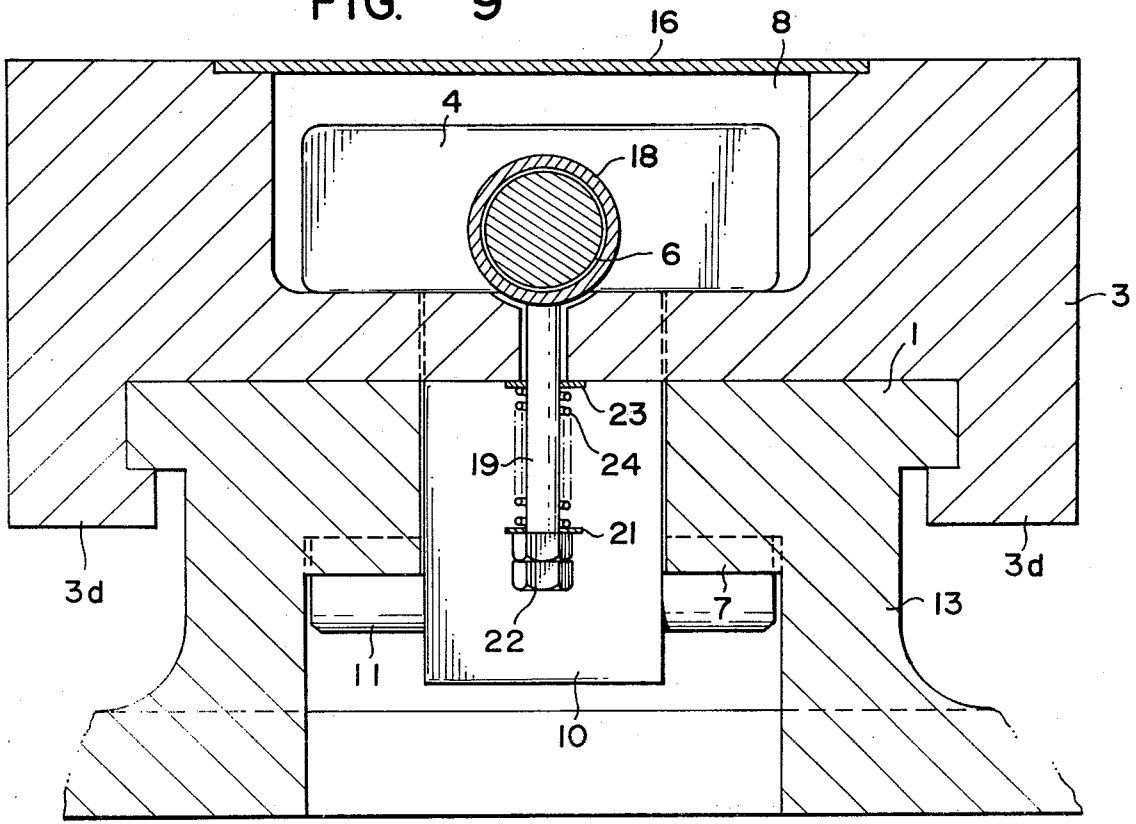
FIG. 9 is a section taken along line IX—IX of FIG. 8.

In the embodiment shown in FIGS. 8 and 9, on the other hand, a holding sleeve 18 is disposed at a clearance around the circumference 6*b* of the bolt 6. A downwardly protruding rod 19 is fixed to the outer circumference of the sleeve 18. On the other hand, the bottom 8*a* of the recess 8 is formed with a through hole 20, within which is received the rod 19 at a clearance. This rod 19 extends downward through the through hole 20 such that a nut 22 is fastened to the lower end of the rod 19 through a washer 21.

Another washer 23 is fitted on the rod 19 at a position to contact with the through hole 20, and a compression spring 24 is interposed between those two washers 21 and 23 such that it is wound upon the rod 19.

The embodiments thus far described with reference to FIGS. 6 to 9 are conceived to provide a structure to prevent a danger. In the large vise for clamping a heavy work, more specifically, the weight of the movable clamping jaw 3 is accordingly increased. When the pin 11 is disengaged from the transverse groove 7 with a view to moving the movable jaw 3, there is a danger that the movable jaw 3 slides on the base toward the stationary clamping jaw 2 so that the operator has his finger bitten between the movable and stationary jaws 3 and 2, if the base 1 is inclined. According to the embodiments thus far described, however, since the bolt 6 is always urged toward the bottom 8*a* of the recess 8 by the action of the helical spring 17 or the compression spring 24, the pin 11 and the transverse groove 7 can be prevented from being disengaged, even if the base 1 is considerably inclined with respect to the horizontal line, so that the movable clamping jaw 3 can also be prevented from moving. On the other hand, in case the rear end of the bolt 6 is raised against the action of the helical spring 17 or the compression spring 24 with a view to moving the movable jaw 3, the bolt 6 is instantly returned to its parallel position with the base by the helical or compression spring 17 or 24 even if the operator's hand leaves the bolt 6 or the movable jaw 3. As a result, the pin 11 is instantly fitted in one of the transverse grooves 7 thereby to hold the movable jaw 3 immovable in position so that the danger that the operator's finger may be bitten between the stationary and movable jaws 2 and 3 can be prevented.

In the embodiments being described, incidentally, the inclining operation of the connecting member 4 can be fasilitated by rounding the corner 15 of the connecting member 4, as has been described in connection with the foregoing embodiments.

Although not shown explicitly in FIGS. 6 to 9, moreover, it goes without saying that the embodiments can be equipped with the spring 14 shown in FIGS. 4 and 5.

We claim:

1. A vise comprising:

an elongated base including a stationary clamping portion at one end and having its widthwise center formed with a longitudinal groove which extends in the longitudinal direction through the upper and lower sides of said base, the lower side of said base being formed with a plurality of transverse grooves which extend at both sides of said longitudinal groove and in parallel with one another;

a movable clamping portion slidably mounted on said base for movement toward and away from said stationary clamping portion, said movable clamping portion having a recess;

a latch means for connecting said movable clamping portion in said base, said latch means including a connecting member having a generally rectangular section and received in the recess of said movable clamping portion, such that said latch means can move within said recess in the longitudinal direction of said base, a generally L-shaped leg made integral with said connecting member and extending from the bottom of said connecting member, and a pin mounted in the free end of said L-shaped leg and engageable with one of said transverse grooves, said connecting member being formed with a threaded hole which is in the moving direction of said movable clamping portion so that a bolt fastened in said threaded hole can have its leading end pushing the side of said recess closest to said stationary clamping portion; and a spring interposed between the rear side of said connecting member and the rear end of said movable clamping portion for biasing said connecting member toward said stationary clamping portion at all times.

2. A vise according to claim 1, further comprising a cover covering the recess of said movable clamping portion.

3. A vise comprising:

an elongated base including a stationary clamping portion at one end and having its widthwise center formed with a longitudinal groove which extends in the longitudinal direction through the upper and lower sides of said base, with the lower side of said base being formed with a plurality of transverse grooves which extend at the both sides of said longitudinal groove and in parallel with one another;

a movable clamping portion slidably mounted on said base for movement toward and away from said stationary clamping portion, said movable clamping portion including a recess;

a latch means for connecting said movable clamping portion and said base, said latch means including a connecting member having a genreally rectangular section and received in said recess in the movable clamping portion, such that the latch means can move within said recess in the longitudinal direction of said base, a generally L-shaped leg made integral with said connecting member and extending from the bottom of said connecting member, and a pin mounted in the free end of the said L-shaped leg and engageable with one of said transverse grooves, said connecting member being formed with a threaded hole which is in the moving direction of said movable clamping portion so that a bolt fastened in said threaded hole can have its leading end pushing the side of said recess closest to said stationary clamping portion; and a bias means connecting said movable clamping portion and said bolt for biasing the rear end of said bolt in the downward direction.

4. A vise as set forth in claim 3 wherein said bias means includes a helical spring extending over the portion of said bolt which extends between the rear side of said connecting member and the rear end of said movable clamping portion, and having its both ends fixed in said recess.

5. A vise according to claim 3, wherein said bias means includes a sleeve mounted on said bolt between the rear side of said connecting member and the rear end of said movable clamping portion, a rod having its one end fixed in said sleeve and extending downward through a through hole in the bottom of said recess, and a spring interposed under compression between the other end of said rod and said through hole and wound on said rod.

6. A vise according to claim 1 or 3, wherein said L-shaped leg is made to extend from the center of said connecting member through a second through hole in the bottom of said recess into the longitudinal groove of said base and is bent to extend within said longitudinal groove towards said stationary clamping portion.

7. A vise according to claim 1 or 3, wherein said recess is made to have a larger width than that of said longitudinal groove and is formed with a bottom which is substantially parallel with said base.

8. A vise according to claim 6, wherein said recess is made to have a larger width than that of said longitudinal groove and is formed with a bottom which is substantially parallel with said base.

* * * * *